US012781493B2

(12) United States Patent
Spires et al.

(10) Patent No.: US 12,781,493 B2
(45) **Date of Patent: *Nov. 3, 2026**

(54) FLARED END RAMP WITH RIBS

(71) Applicant: Advanced Drainage Systems, Inc., Hilliard, OH (US)

(72) Inventors: Gregory Spires, Powell, OH (US); Gregory Baryluk, Columbus, OH (US); Brian Rustia, Fairfax Station, VA (US); Irena Makarchuk, Fairfield, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/416,672

(22) Filed: Jan. 18, 2024

(65) Prior Publication Data

US 2024/0209613 A1 Jun. 27, 2024

Related U.S. Application Data

(63) Continuation-in-part of application No. 18/318,952, filed on May 17, 2023, now Pat. No. 12,644,271.
(Continued)

(51) Int. Cl.
*E03F 3/04* (2006.01)
*E03F 1/00* (2006.01)

(52) U.S. Cl.
CPC ..... *E03F 1/002* (2013.01)

(58) Field of Classification Search
CPC .. E03F 1/002; E03F 1/003; E03F 3/04; E02B 11/005; E04D 2013/0813
See application file for complete search history.

(56) References Cited

U.S. PATENT DOCUMENTS 980,442 A 1/1911 Schlafly
2,334,779 A 11/1943 Luff
(Continued)

FOREIGN PATENT DOCUMENTS

CN 108487410 A 9/2018

OTHER PUBLICATIONS

Advanced Drainage Systems, Inc., *ADS Driveway Culvert Installation*, Feb. 5, 2013, YouTube, retrieved Sep. 21, 2020, from https://www.youtube.com/watch?v=r817BfCtRGU (3 pages).
(Continued)

*Primary Examiner* — Amber R Anderson
*Assistant Examiner* — Stacy N Lawson
(74) *Attorney, Agent, or Firm* — FINNEGAN, HENDERSON, FARABOW, GARRETT & DUNNER L.L.P.

(57) ABSTRACT

A flared end ramp for managing and distributing fluid runoff. The flared end ramp may have an inlet end configured to connect to a pipe, a plurality of protrusions on the upper side of the inlet end, and an outlet end. An inclined surface may extend between the inlet end and the outlet end of the flared end ramp, the outlet end of the flared end ramp has a larger width than the inlet end of the flared end ramp such that the inclined surface is angled laterally outward from the inlet end toward the outlet end. The flared end ramp may include a tab positioned on an edge of the outlet end, the tab extending vertically relative to the outlet end. The flared end ramp may be placed inside a stormwater chamber, and the tab may be positioned outside of the stormwater chamber.

18 Claims, 8 Drawing Sheets

Related U.S. Application Data

(60) Provisional application No. 63/364,885, filed on May 18, 2022.

(56) References Cited

U.S. PATENT DOCUMENTS 2,800,925 A * 7/1957 Palisades ..... E04D 13/08 239/518
3,048,983 A 8/1962 Crummel
4,245,924 A 1/1981 Fouss
4,246,936 A 1/1981 Luz
4,359,167 A 11/1982 Fouss
4,523,613 A 6/1985 Fouss
4,759,661 A 7/1988 Nichols
4,824,287 A 4/1989 Tracy
5,017,041 A 5/1991 Nichols
5,065,554 A 11/1991 Neva
5,087,151 A 2/1992 DiTullio
5,129,758 A 7/1992 Lindstrom
5,156,488 A 10/1992 Nichols
5,336,017 A 8/1994 Nichols
5,358,006 A 10/1994 Sweers
5,358,007 A * 10/1994 Carlberg ..... F16L 27/08 137/561 A
5,401,459 A 3/1995 Nichols
5,419,838 A 5/1995 DiTullio
5,441,363 A 8/1995 Gray
5,498,104 A 3/1996 Gray
5,511,903 A 4/1996 Nichols
5,556,231 A 9/1996 Sidaway et al.
5,588,778 A 12/1996 Nichols
5,658,092 A 8/1997 Sweers
5,839,844 A 11/1998 Nichols et al.
5,890,837 A 4/1999 Wells
5,890,838 A 4/1999 Moore, Jr.
6,076,993 A 6/2000 Gray
6,240,680 B1 * 6/2001 Estes ..... E04D 13/08 52/16
6,270,287 B1 8/2001 Gray
6,350,374 B1 2/2002 Stever
6,361,248 B1 3/2002 Maestro
6,533,498 B1 3/2003 Quin
D477,381 S 7/2003 Benecke
6,602,023 B2 8/2003 Crescenzi
6,612,777 B2 9/2003 Maestro
6,698,975 B1 3/2004 Benecke
6,991,734 B1 1/2006 Smith et al.
7,008,138 B2 3/2006 Burnes
7,052,209 B1 5/2006 Kruger
7,118,306 B2 10/2006 Kruger
7,134,808 B2 11/2006 Albone
D537,912 S 3/2007 Benecke
7,189,027 B2 3/2007 Brochu
7,217,063 B2 5/2007 Moore, Jr.
7,226,241 B2 6/2007 DiTullio
7,237,981 B1 7/2007 Vitarelli
D549,836 S 8/2007 Desbiens
7,273,330 B1 9/2007 Brochu
7,300,226 B1 11/2007 Maestro
7,306,399 B1 12/2007 Smith
D566,852 S 4/2008 Gaster
7,351,005 B2 4/2008 Potts
7,364,384 B1 4/2008 Swistak
7,384,212 B2 6/2008 Currivan
7,419,332 B1 9/2008 Brochu
7,473,053 B1 1/2009 Brochu
7,500,805 B1 3/2009 Brochu
7,517,172 B2 4/2009 Sipaila
7,611,306 B1 11/2009 Hallahan
7,614,825 B2 11/2009 Kroger
7,628,566 B2 12/2009 Miskovich
7,798,747 B1 9/2010 de Bruijn
7,806,627 B2 10/2010 DiTullio
7,887,256 B2 2/2011 Miskovich
7,914,231 B2 3/2011 Coppes
D638,094 S 5/2011 DiTullio
D638,095 S 5/2011 DiTullio
8,007,201 B2 8/2011 Currivan
D653,352 S 1/2012 Jacques
8,147,688 B2 4/2012 Adams
8,366,346 B2 2/2013 DiTullio
8,414,222 B2 4/2013 DiTullio
8,425,148 B2 4/2013 DiTullio
8,491,224 B2 7/2013 Cobb
8,636,444 B2 1/2014 Currivan
8,672,583 B1 3/2014 Mailhot
8,858,119 B2 10/2014 Wynne
8,955,258 B2 2/2015 Jacques
D728,825 S 5/2015 Miskovich
9,290,924 B2 3/2016 Wynne
9,556,576 B2 1/2017 Mailhot
9,580,898 B2 2/2017 Wynne
9,637,907 B2 5/2017 Mailhot
9,765,509 B1 9/2017 DiTullio
9,809,968 B1 11/2017 Holbrook
D806,827 S 1/2018 Mailhot
D840,499 S 2/2019 DiTullio
11,028,570 B2 6/2021 Spires
2002/0025226 A1 2/2002 Maestro
2002/0044833 A1 4/2002 Kruger
2002/0067952 A1 6/2002 Crescenzi et al.
2003/0095838 A1 5/2003 Maestro
2004/0184884 A1 9/2004 DiTullio
2005/0074285 A1 4/2005 Burnes
2005/0074287 A1 4/2005 Brochu
2005/0074288 A1 4/2005 Moore, Jr.
2005/0111915 A1 5/2005 Moore, Jr.
2005/0238434 A1 10/2005 Coppes
2007/0258770 A1 11/2007 Miskovich
2008/0138156 A1 6/2008 Janesky
2008/0226394 A1 9/2008 Coppes
2008/0240859 A1 10/2008 Sipaila
2009/0003933 A1 1/2009 Anderson et al.
2009/0220302 A1 9/2009 Cobb et al.
2010/0059430 A1 3/2010 Adams et al.
2010/0329787 A1 12/2010 Moore, Jr. et al.
2011/0200391 A1 8/2011 Mailhot et al.
2012/0085431 A1 4/2012 Spano, Jr. et al.
2013/0118625 A1 * 5/2013 Bell ..... E04D 13/08 138/37
2015/0211198 A1 7/2015 Mailhot
2017/0350131 A1 * 12/2017 Ayala ..... E04D 13/08
2018/0010325 A1 1/2018 Mailhot et al.
2020/0354941 A1 * 11/2020 Spires ..... E03F 1/003

OTHER PUBLICATIONS

Advanced Drainage Systems, Inc., *StormTech Installation*, Mar. 6, 2015, YouTube, retrieved Sep. 21, 2020, from uhttps://www.youtube.com/watch?v=-PZ9P2NyD44 (4 pages).
International Search Report and Written Opinion of the International Searching Authority from the U.S. Patent and Trademark Office for related International Application No. PCT/US2019/059283, mailed Aug. 12, 2020 (9 pages).
International Search Report and Written Opinion of the International Searching Authority from the U.S. Patent and Trademark Office for related International Application No. PCT/US2020/043543, mailed Oct. 8, 2020 (10 pages).
International Search Report and Written Opinion of the International Searching Authority from the U.S. Patent and Trademark Office for related International Application No. PCT/US2020/043557, mailed Sep. 16, 2020 (7 pages).

* cited by examiner

FLARED END RAMP WITH RIBS

CROSS REFERENCE TO RELATED APPLICATION

This application is a continuation in part of U.S. patent application Ser. No. 18/318,952, filed May 17, 2023, which claims benefit of priority of U.S. Provisional Patent Application 63/364,885, filed on May 18, 2022. The content of the foregoing applications are incorporated herein by reference in its entirety.

TECHNICAL FIELD

This disclosure relates generally to systems, apparatus, and methods for managing fluid run-off. In particular, this disclosure relates to a flared end ramp for use in dispersing fluid from a pipe to a surface.

BACKGROUND

Fluid run-off systems include systems designed to process rainwater or other fluid run-off and particularly stormwater. Related stormwater management systems known in the art include chamber systems designed primarily for use under parking lots, roadways, and heavy earth loads.

Stormwater chambers may be thermoplastic, injection molded, and formed of polypropylene, polyethylene, or a combination thereof. Such chambers may have arched cross-sections and may be formed to have long, narrow configurations with advantageously compact footprints that optimize the use of space. Each arch-shaped stormwater chamber defines an open bottom. The chamber may be installed and placed on crushed stone or other porous medium, which constitutes a floor of the chamber underlying the arch. The chamber may be formed to include corrugations, which may be advantageously shaped and configured to accommodate efficient stormwater or fluid run-off management and debris collection. One or more chambers may include an inlet configured to connect to a stormwater collection system, which may include one or more drain basins that receive fluid run-off from a parking lot, roof, or street, for example. The one or more chambers are designed to distribute collected stormwater into the ground.

Stormwater carries debris and solid contaminants that can pass into and through basins, traps, and filters of conventional stormwater management systems. Stormwater may include suspended solids, including, for example, dirt, sand, and organic debris such as leaves, paper, and plastic. Stormwater management system chambers may be configured to receive stormwater and allow debris to settle to a bottom of the chamber before the stormwater is released into the ground.

Related stormwater management systems known in the art may include underground stormwater chambers that may also be encased in a geotextile mesh or filter fabric forming a fine mesh made of any suitable material. The filter fabric encases the chamber, interposing the chamber and the crushed stone floor. Debris and solid contaminants have been found to locally mask and block exit points in the filter fabric, impeding outflow of fluid or water from the chamber into the ground.

Accordingly, maintenance is required to ensure optimal functionality of chambers. Debris is typically manually removed from an interior of a chamber using a system or device configured to jet water into and through an interior of the chamber to force debris and fluid out of the chamber for collection by vacuum, e.g., a jetvac system. In particular, jetvac systems use a high-pressure water nozzle to propel water through a length of a chamber to suspend and remove sediment. The high-pressure spray from the nozzle causes the sediment to exit the chamber into, for example, a connected basin wherein the collected sediment is collected by vacuuming. The jetvac system and similar cleaning devices can snag, tear, or otherwise disrupt the filter fabric material, damaging the efficacy and functionality of the chamber.

It has been found that debris may become lodged and packed on the back or interior side of the dome chamber. The debris is not easily removed using conventional maintenance techniques including jetting and vacuuming. Additionally, nozzles and other components of jetting and cleaning devices have been found to become lodged and caught on an interior side of chamber entrance when being extracted from the chamber through a chamber outlet or pipe stub attached to the end cap.

Systems, apparatuses, and techniques for enhancing ease of chamber maintenance in chamber-type stormwater management systems may include use of a flared end ramp that facilitates removal of debris from the chamber during jetting and prevents debris from collecting on an interior surface side of an end cap of the chamber. An example of a flared end ramp is disclosed by U.S. Pat. No. 11,028,570 to Spires, titled Systems, Apparatus, and Methods for Maintenance of Stormwater Management Systems, the entire disclosure of which is incorporated herein by reference.

It has been found that additional problems may arise with flared end ramps known in art. For example, debris may accumulate underneath the outlet end of the flared end ramp which may cause the outlet end to lift above the bottom of the chamber. Cleaning activities such as jetvac and high-pressure water spray may shift the flared end ramp laterally within the chamber and may cause separation between the flared end ramp and the pipe. Methods of securing the pipe with the flared end ramp may be difficult to implement due to constrained access to the connection point between the pipe and the flared end ramp.

Solutions are needed to address these and other deficiencies in the prior art. Solutions should include structural features for securing the placement of the flared end ramp within a stormwater chamber and should prevent unwanted lateral or vertical movement of the flared end ramp within the chamber. Solutions should also improve the connection between the inlet pipe and the flared end ramp to decrease the difficulty of installation and connection of inlet pipes to flared end ramps.

SUMMARY

A need has been recognized for securing the placement of flared end ramps within stormwater chambers. A need has also been recognized for improving the connections between inlet pipes and flared end sections within stormwater chambers. Solutions, apparatus, and methods are disclosed that allow for flared end ramps to be securely placed within stormwater chambers and may prevent unwanted vertical and lateral movement of the flared end ramps within the chambers. Solutions, apparatus, and methods are also disclosed to secure flared end ramps to pipes or pipes stubs.

In an embodiment, a flared end ramp may be provided for managing flow of material into a stormwater chamber. The flared end ramp may include an inlet end configured to connect to a pipe. The flared end ramp may include a plurality of protrusions on the upper side of the inlet end. The protrusions may be separated by a gap in an initial state. The flared end ramp may further include one or more fasteners configured to connect the protrusions on the upper side of the inlet end. Connecting the protrusions on the upper side of the inlet end may tighten the fit between the flared end ramp and a pipe, thereby securing the flared end ramp to the pipe. In an embodiment, the fastener may be a threaded rod. In another embodiment, the fastener may be one or more zip ties.

The flared end ramp may include an outlet end. The outlet end may be configured for placement within a stormwater chamber. In some embodiments, the flared end ramp may include an inclined surface extending between the inlet end and the outlet end of the flared end ramp configured to deliver material from the pipe into a stormwater chamber. In other embodiments, the outlet end of the flared end ramp may have a larger width than the inlet end of the flared end ramp such that the inclined surface is angled laterally outward from the inlet end toward the outlet end.

In some embodiments, the flared end ramp may include at least one support foot configured to support the flared end ramp. The support foot may be located at the outlet end of the flared end ramp and may extend laterally from the flared end ramp. The support foot may include one or more tabs positioned on an edge of the outlet end and one or more inner tabs positioned on the support foot. The edge tabs and the inner tabs may extend vertically relative to the outlet end. In another embodiment, there may be two edge tabs and two inner tabs positioned on opposite ends of the outlet end. In an embodiment, the flared end ramp may be placed inside a stormwater chamber and the outlet end may be wider than the stormwater chamber so that the edge tabs may be positioned outside of the stormwater chamber and the inner tab may be positioned inside the stormwater chamber.

In an embodiment, the inclined surface may include one or more drainage grooves extending between the inlet end of the flared end ramp and the outlet end of the flared end ramp. The drainage grooves may be angled laterally outward from the inlet end toward the outlet end and may act to channel or direct the flow of fluid down the inclined surface to widely disperse the fluid at the outlet end.

In an embodiment, the inclined surface may include one or more drainage ribs extending between the inlet end and the outlet end of the flared end ramp. The drainage ribs may be angled laterally outward from the inlet end toward the outlet end and may direct the flow of fluid down the inclined surface to widely disperse the fluid at the outlet end.

In an embodiment, the inlet end may comprise an inlet configured to prevent the pipe from sliding toward the outlet end. In another embodiment, the inlet end may be rounded with a curvature corresponding to the radius of the inlet pipe wherein the indent protrudes upward from the upper side of the inlet end to a distance that is level with the inside diameter of the pipe. Such a configuration may prevent the pipe from sliding toward the outlet end.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Figure 1:
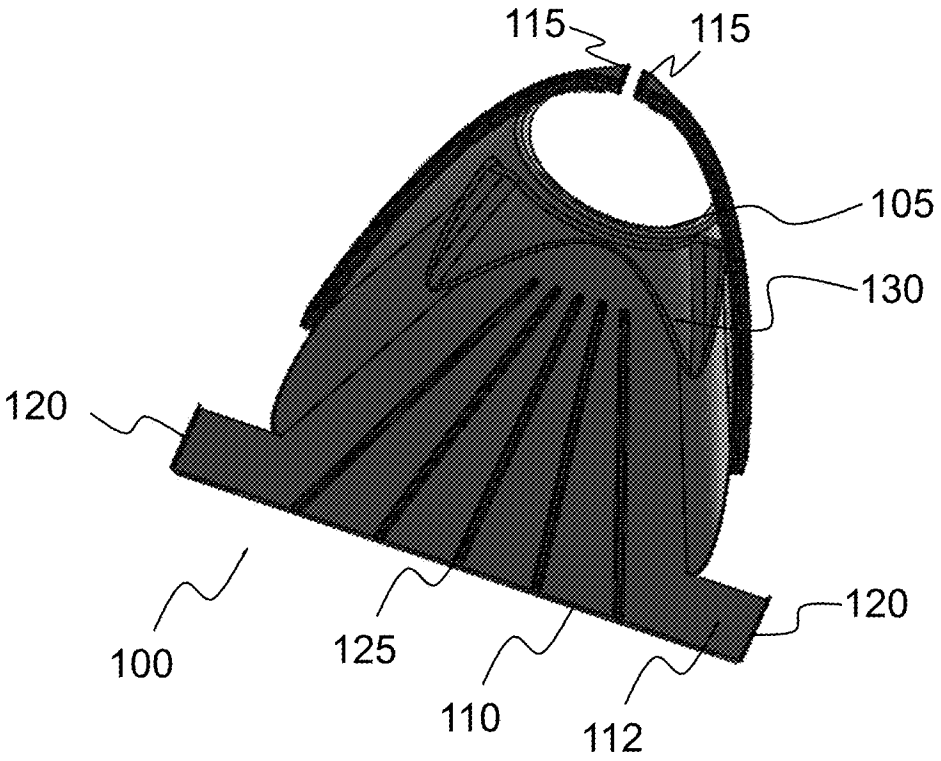
FIG. 1 depicts an embodiment of a flared end ramp, consistent with various embodiments of the present disclosure.

Exemplary embodiments are described with reference to the accompanying drawings. In the figures, which are not necessarily drawn to scale, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and are intended to be open ended such that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

A solution may be provided by embodiments disclosed herein to the recognized need for improving the stability and placement of flared end ramps and improving the connection and fit between flared end ramps and inlet pipes. In particular, apparatuses and devices in accordance with embodiments of the present disclosure may enable flared end ramps to be securely fixed laterally and vertically within a stormwater chamber. Solutions are disclosed that improve the connection between flared end ramps and inlet pipes by easing access to fasteners and fastener locations that secure inlet pipes to flared end ramps.

In various embodiments, a flared end ramp apparatus may be provided that is constructed and arranged to attach to, or be placed within, a chamber useful for a chamber-type stormwater management system. In particular, the ramp may be constructed and arranged to attach to, or be placed within, an interior surface of an end cap of a chamber of a stormwater management system. In this configuration, fluid and solid materials may exit an interior of the chamber by traversing the ramp and passing through an exit defined by the end cap of the chamber. For example, the ramp may be left in place during use of the stormwater system and may be available for periodic cleaning.

The ramp apparatus may be configured to improve chamber function over time, and may have a shape, form, and profile that is non-obtrusive and does not frustrate chamber function. For example, the ramp apparatus may provide an inclined surface from a ground on which the chamber is positioned to an exit passage at an end of the chamber. The ramp apparatus may be shaped to guide fluid and debris through the exit and away from the portions of the chamber interior at which debris and sediment may typically collect in related art systems, such as at the end cap interior around the exit of the chamber. The ramp apparatus may include vertical tabs positioned on the edge of the outlet end of the ramp that correspond with the exterior of the stormwater chamber, which may secure the flared end ramp and prevent unwanted lateral or vertical movements of the ramp.

FIG. 1 depicts an embodiment of a flared end ramp 100. Flared end ramp 100 may be constructed of plastic (e.g., polypropylene, HDPE, LDPE, PVC), metal, and/or any other suitable material. Flared end ramp 100 may have an inlet end 105. Inlet end 105 may be configured to connect to an inlet pipe. Inlet end 105 of flared end ramp 100 may have a smaller width than outlet end 110. This configuration may enable flared end ramp 100 to prevent sediment in runoff from accumulating around the inlet end cap of a stormwater chamber by distributing the runoff (and the sediment contained therein) away from the chamber's inlet end and across the entire width of the chamber. Flared end ramp 100 may include at least one support foot 112 attached to a bottom portion of the ramp at or near outlet end 110. The at least one support foot 112 may extend laterally from flared end ramp 100 to form a wide structure configured to support the ramp. On an end of support foot 112, there may be an edge tab 120. Edge tab 120 may extend vertically upward relative to support foot 112.

In some embodiments, inlet end 105 may include a plurality of protrusions 115 on the upper side of the inlet end 105. Protrusions 115 may be separated by a gap in an initial state and may deflect to allow placement of an inlet pipe into inlet end 105.

Flared end ramp 100 may also include one or more drainage channels 125, which may be formed in the inclined surface to promote flow of runoff from inlet end 105 towards outlet end 110. For example, as depicted in FIG. 1, flared end ramp 100 may include a drainage channel 125 extending from near the center of the inclined surface at inlet end 105 laterally outward towards outlet end 110. Advantageously, in some embodiments, drainage channels 125 may promote runoff away from the center of the flared end ramp towards the sides of the flared end ramp, thereby dispersing fluid towards chamber side walls and away from the chamber center when the flared end ramp 100 is placed inside a stormwater chamber.

In some embodiments, flared end ramp 100 may include an indent 130 at or near inlet end 105, indent 130 being configured to prevent the pipe from sliding towards outlet end 110. Indent 130 may be rounded with a curvature corresponding to the radius of the inlet pipe where indent 130 protrudes upward from the upper side of inlet end 105 to a distance that is level with the inside diameter of the inlet pipe. Indent 130 may prevent an inlet pipe from sliding toward outlet end 110 by providing a stop for an inlet pipe to abut against when inserted into inlet end 105.

Figure 2:
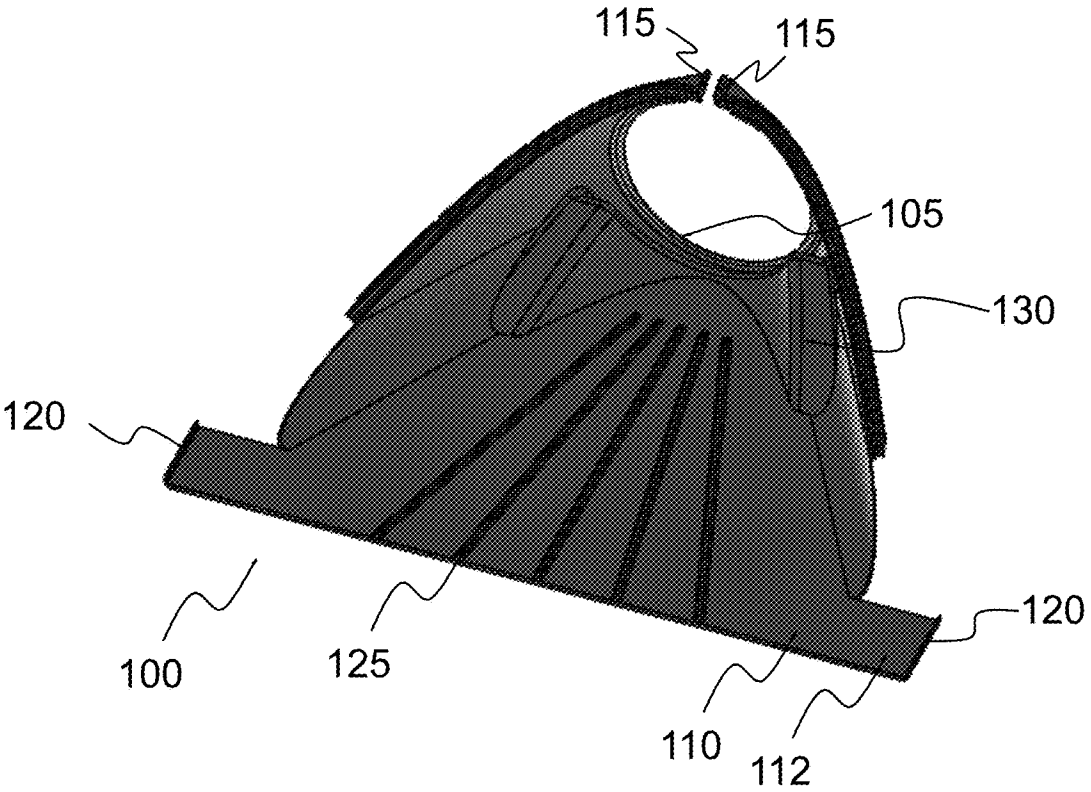
FIG. 2 depicts another embodiment of a flared end ramp, consistent with various embodiments of the present disclosure.

Flared end ramps may be constructed with inlet ends suitable for various different sizes of inlet pipes or stormwater chambers. For example, FIG. 2 depicts another embodiment of a flared end ramp that has a wider outlet end 110 than the flared end ramp shown in FIG. 1. One skilled in the art will appreciate that a variety of sizes of the inlet end or outlet end may be constructed for a variety of applications.

Figure 3A:
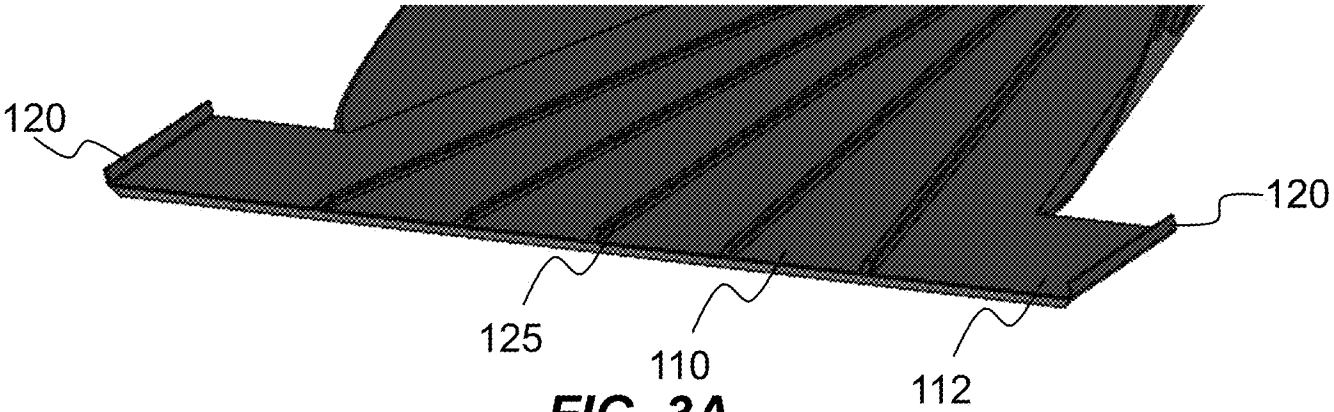
FIG. 3A depicts a close-up view of an embodiment of a flared end ramp outlet end, consistent with various embodiments of the present disclosure.

FIG. 3A depicts a close-up view of an embodiment of a flared end ramp outlet end 110. As is shown in FIG. 3A, a drainage channel 125 is formed by a pair of raised ridges on the flared end ramp 100. Fluid in drainage channel 125 may travel between the raised ridges between the inlet end 105 and the outlet end 110.

Figure 3B:
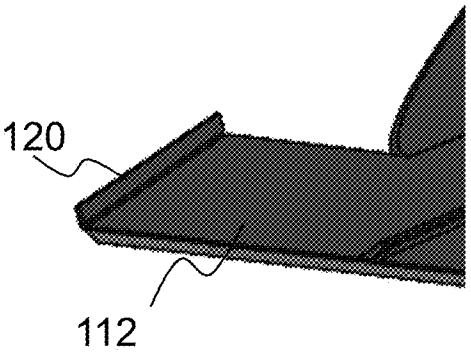
FIG. 3B depicts a close-up view of an embodiment of a tab positioned on an edge of the outlet end of a flared end ramp, consistent with various embodiments of the present disclosure.

FIG. 3B depicts an embodiment of a support foot 112 with an edge tab 120. Edge tab 120 may extend vertically compared to support foot 112. In some embodiments, flared end ramp 100 may be placed inside a stormwater chamber and support foot 112 may extend underneath the chamber walls, with edge tab 120 positioned outside of the chamber. Such an arrangement provides several advantages. For example, the weight of the chamber and overlying material bears on the support foot 112, thereby securing the flared end ramp 100 to a ground surface and preventing the flared end ramp from rising up or becoming undermined with debris from cleaning operations. Edge tab 120 extends vertically upward and may abut the outside of the chamber wall, which prevents the flared end ramp 100 from shifting in a lateral direction.

Figure 4:
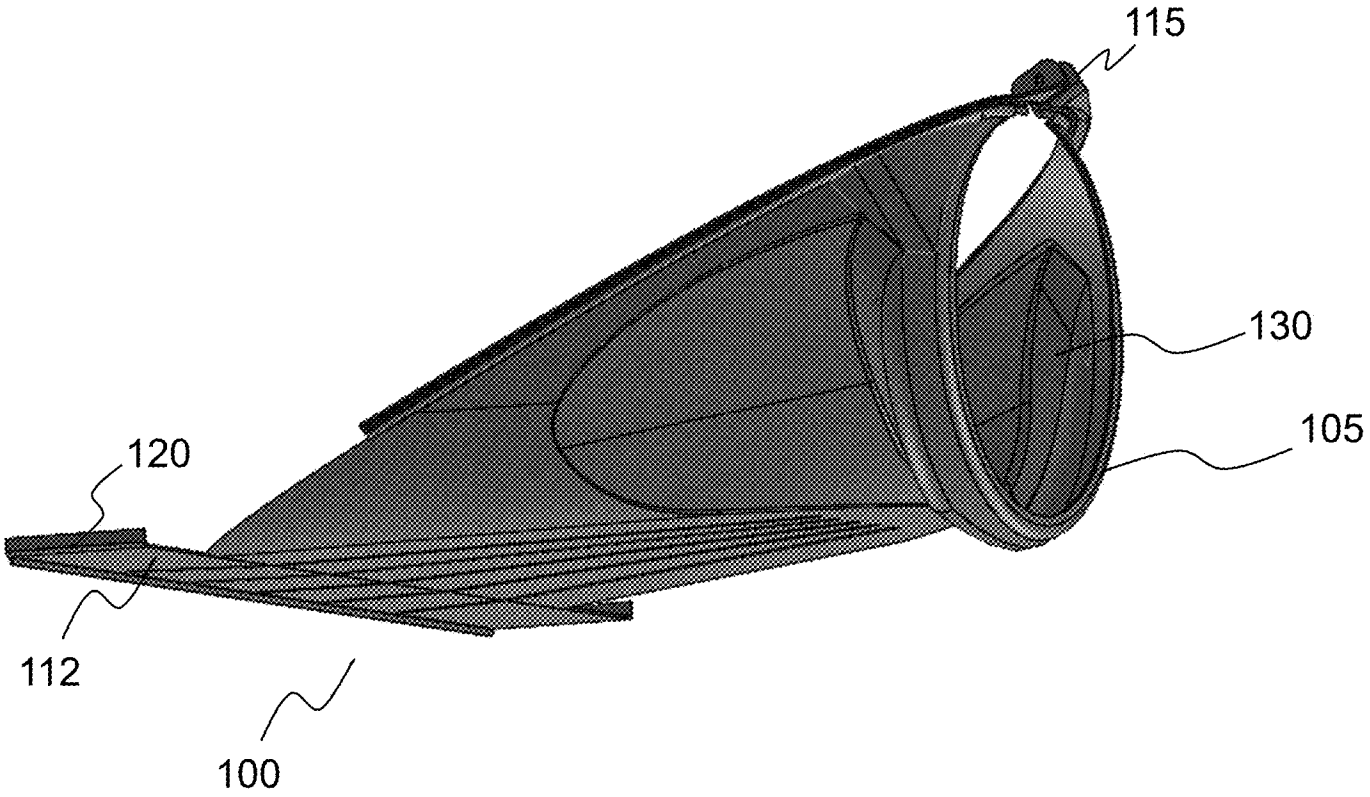
FIG. 4 depicts a view of an embodiment of a flared end ramp viewed from a lower-right perspective.

FIG. 4 depicts a view of an embodiment of a flared end ramp viewed from a lower-right perspective. As shown in FIG. 4, indent 130 may function as a pipe stop in that the indent extends laterally inward from inlet end 105 and restrains a pipe from sliding toward outlet end 110. In an embodiment, indent 130 may be rounded with a curvature corresponding to the radius of an inlet pipe and indent 130 may protrude upward from the upper side of the inlet end to a distance that is level with the inside diameter of the pipe. Such an arrangement may align the invert of an inlet pipe with the edge of the indent 130 and may provide for free flow of fluid from the inlet pipe into the flared end ramp 100 and the chamber. Additionally, indent 130 may prevent catch points and allow for a smooth transition of a jet vac during maintenance operations.

Figure 5:
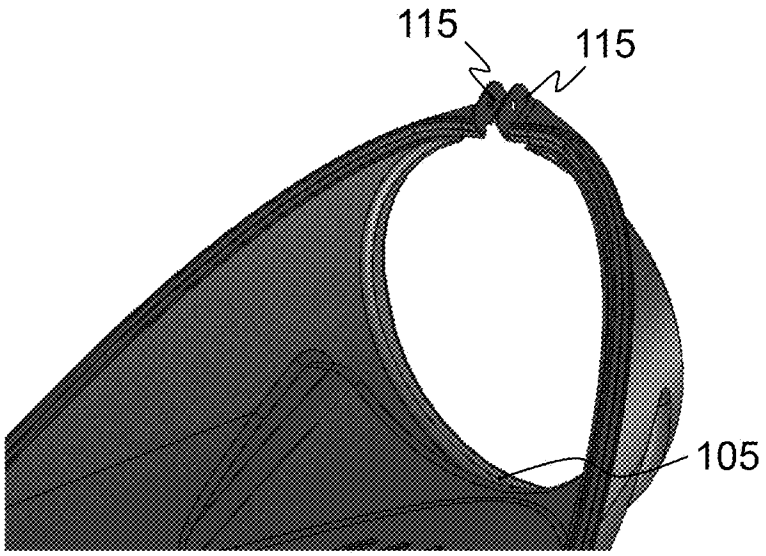
FIG. 5 depicts the inlet end of an embodiment of a flared end ramp that includes protrusions on the upper side of the inlet end, consistent with various embodiments of the present disclosure.

FIG. 5 depicts an embodiment of inlet end 105 of a flared end ramp 100 that includes protrusions 115 on the upper side of the inlet end 105. There may be a gap between protrusions 115 which allows for the placement of an inlet pipe in the inlet end 105. In an embodiment, inlet end 105 may be flexible so as to allow tolerances for placement of an inlet pipe within the inlet end. In another embodiment, inlet end 105 and protrusions 115 are rigid and do not flex.

Figure 6B:
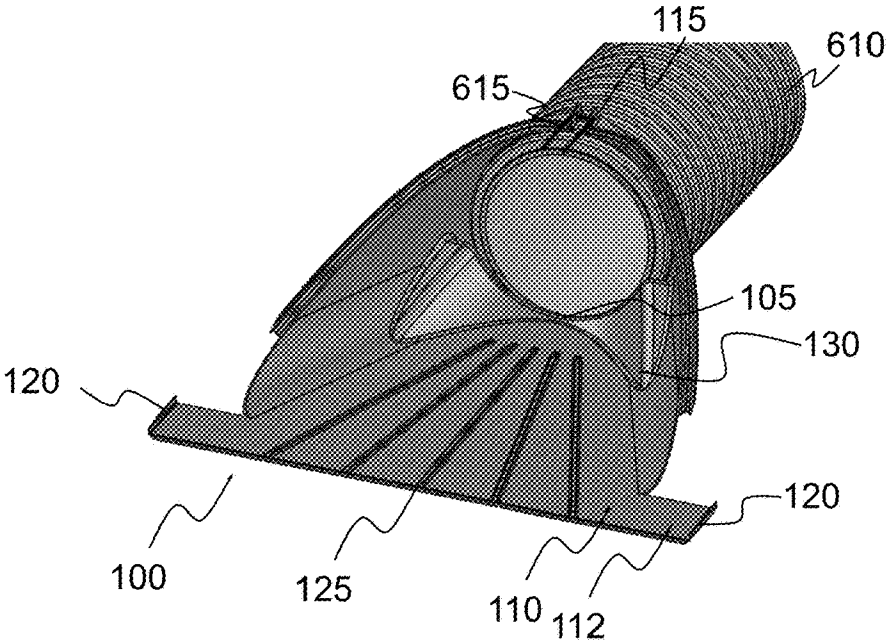
FIG. 6B depicts another embodiment of a flared end ramp connected to a pipe, consistent with various embodiments of the present disclosure.
Figure 6A:
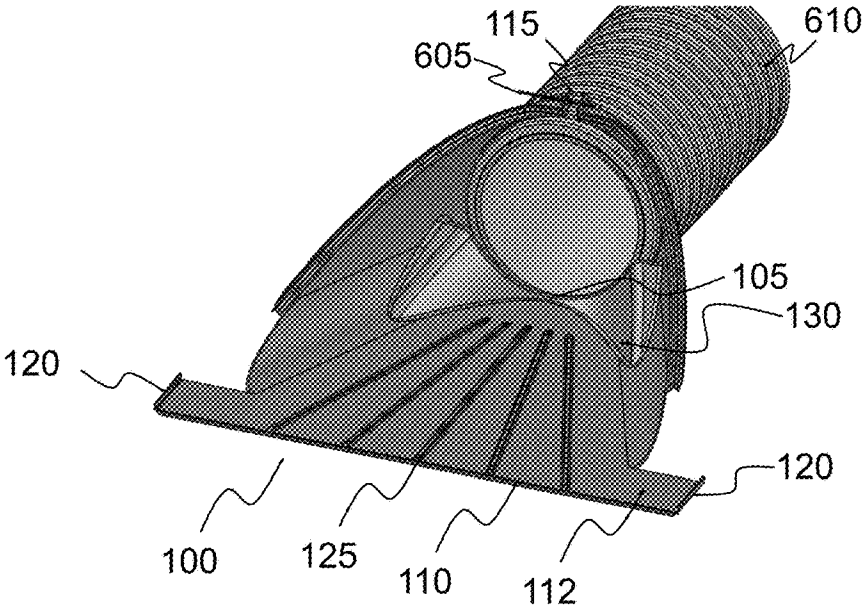
FIG. 6A depicts an embodiment of a flared end ramp connected to a pipe, consistent with various embodiments of the present disclosure.

FIGS. 6A and 6B depict embodiments of a flared end ramp 100 connected to a pipe 610. Various types of fasteners may be used to connect protrusions 115. Connecting protrusions 115 with a fastener may secure the inlet pipe 610 to the flared end ramp 100. In the embodiment depicted in FIG. 6A, a threaded rod 605 type fastener is used. Threaded rod 605 may be secured and tightened with a nut, thereby pinching protrusions 115 together to secure inlet pipe 610 to flared end ramp 100. In the embodiment depicted in FIG. 6B, zip ties are used as a fastener to tighten protrusions 115 to secure inlet pipe 610 to the flared end ramp 100. In other embodiments, various other forms of fasteners may be used such as bolts, screws, studs, clamps, or rivets. In other embodiments, adhesives, cements, or various solvent welding techniques may be used to secure protrusions 115 or may be applied to inlet pipe 610 to secure it to flared end ramp 100.

Figure 7:
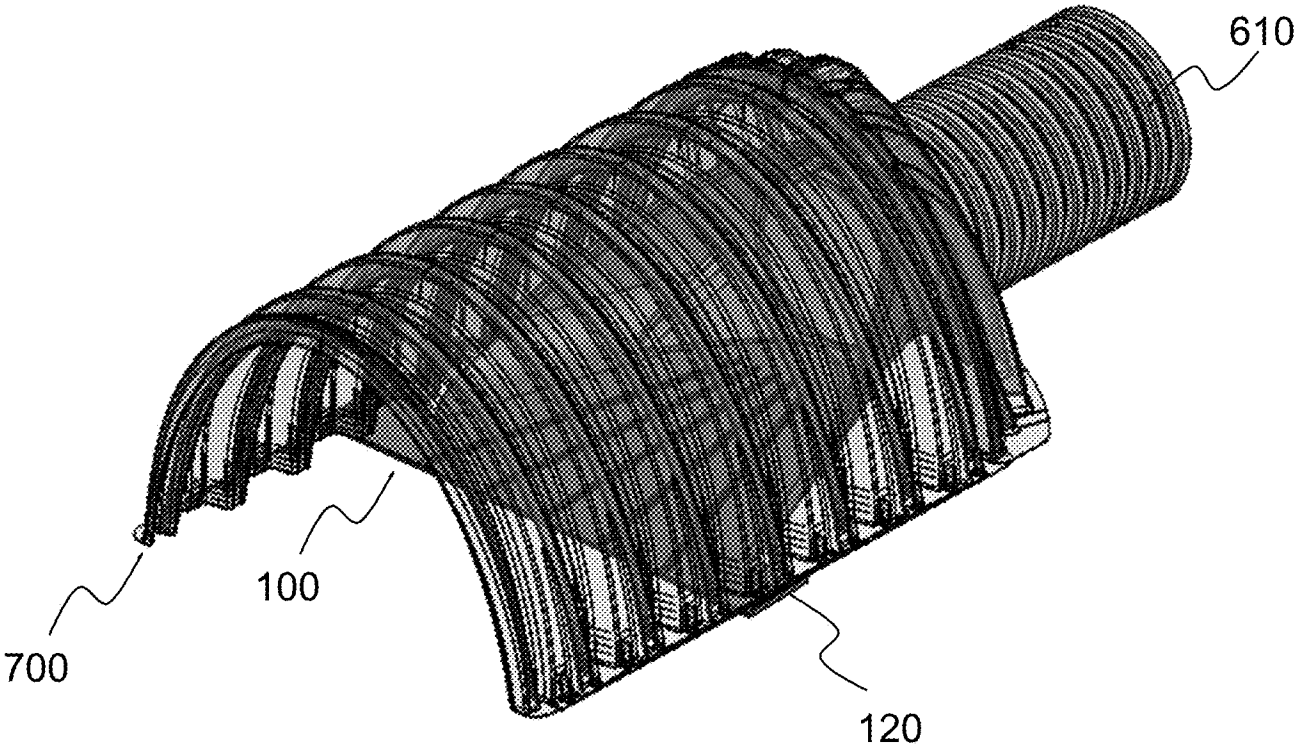
FIG. 7 depicts an embodiment of a flared end ramp connected to a pipe that is inserted into a stormwater chamber, with the stormwater chamber shown in semi-transparency for clarity.

FIG. 7 depicts an embodiment of a flared end ramp 100 connected to a pipe 610 that is inserted into a stormwater chamber 700. Flared end ramp 100 may span the width of chamber 700, and edge tabs 120 may extend outside the external walls of chamber 700 as described above. In an embodiment, stormwater chamber 700 may rest on support foot 112 of flared end ramp 100, securing the flared end ramp 100 to the ground surface with the weight of the chamber 700. Edge tabs 120 may freely extend outside of the chamber to prevent lateral movement of the flared end ramp 100. In other embodiments, edge tabs 120 may attach to chamber 700. For example, edge tabs 120 may be secured to the chamber 700 with fasteners, welds, or clamps. Alternatively, edge tabs 120 may be configured to interlock mechanically with a receptacle positioned on the outside of chamber 700, for example, a snap-style connection wherein edge tab 120 acts as a hook to a counterpart receptacle on the chamber 700.

Figure 8:
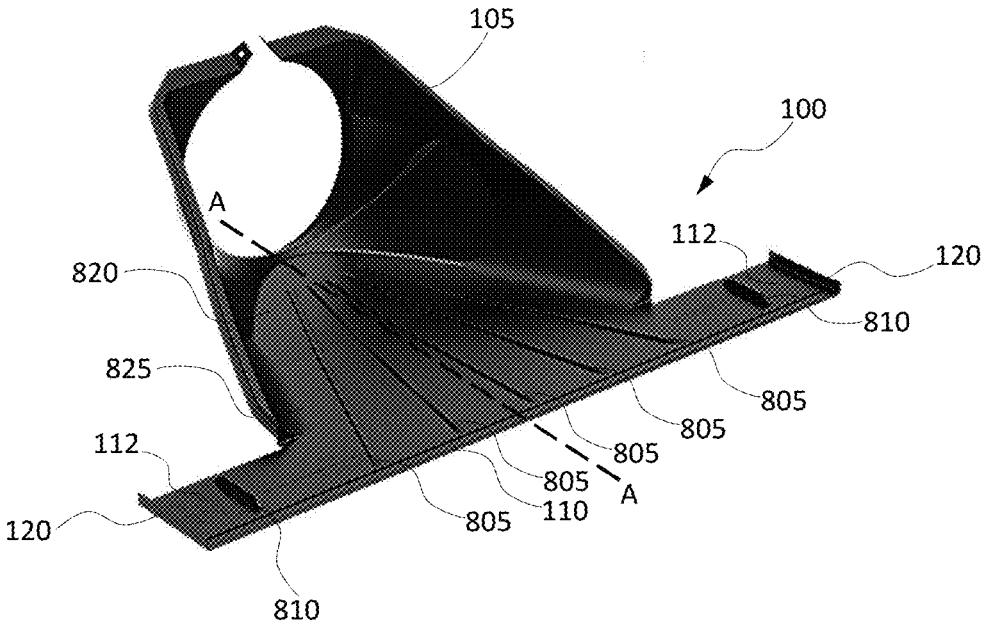
FIG. 8 depicts an embodiment of a flared end ramp with drainage ribs, consistent with various embodiments of the present disclosure.

FIG. 8 depicts an embodiment of flared end ramp 100 with drainage ribs 805. Flared end ramp 100 may comprise a plurality of drainage ribs 805. Drainage ribs 805 may comprise raised extrusions that extend vertically from the inclined surface to promote the flow of runoff from inlet end 105 towards outlet end 110. In some embodiments, as depicted in FIG. 8, drainage ribs 805 may extend across only a portion of the inclined surface. For example, in some embodiments, drainage ribs 805 may extend to any length from 43 inches to 56 inches along the inclined surface of flared end ramp 100. In other embodiments, drainage ribs 805 may extend completely from inlet end 105 to outlet end 110. In some embodiments, each drainage rib 805 on flared end ramp 100 may have an identical length. In other embodiments, one or more of a plurality of drainage ribs 805 on flared end ramp 100 may have different lengths. Moreover, in some embodiments one or more drainage ribs 805 may terminate at different distances from outlet end 110, while in other embodiments each drainage rib 805 may terminate at the same distance from outlet end 110.

In some embodiments, as depicted in FIG. 8, flared end ramp 100 may comprise five drainage ribs 805. In other embodiments, flared end ramp 100 may comprise more or fewer drainage ribs 805. Flared end ramp 100 may include drainage ribs 805 extending from near the center of the inclined surface at inlet end 105 laterally outwards towards outlet end 110. Drainage ribs 805 may promote runoff away from the center of the flared end ramp 100 towards the sides of the flared end ramp 100, thereby dispersing fluid towards chamber side walls and away from the chamber center when the flared end ramp 100 is placed inside a stormwater chamber. Further, drainage ribs 805 may provide structural strength to the inclined surface extending between inlet end 105 and outlet end 110.

Flared end ramp 100 may further comprise inner tab 810. Inner tab 810 may extend vertically from support foot 112. In some embodiments, as depicted in FIG. 8, flared end ramp 100 may comprise one support foot 112 with edge tab 120 and inner tab 810 on each side of outlet end 110. In other embodiments, flared end ramp 100 may comprise only one support foot 112 with edge tab 120 and inner tab 810 on one side of outlet end 110. In some embodiments, flared end ramp 100 may be placed inside a stormwater chamber. Support foot 112 may extend underneath the chamber walls, with edge tab 120 positioned outside the chamber and inner tab 810 positioned inside the chamber. The weight of the chamber and overlying material may bear on the support foot 112, thereby securing the flared end ramp 100 to a ground surface and preventing the flared end ramp from rising up or becoming undermined with debris from cleaning operations. Edge tab 120 may abut the outside of the chamber wall and inner tab 810 may abut the inside of the chamber wall, which may prevent the flared end ramp 100 from shifting in a lateral direction.

The inclined surface of flared end ramp 100 may further comprise a first sloped portion 820 and a second sloped portion 825. First sloped portion 820 of the inclined surface may extend from inlet end 105 to second sloped portion 825. Second sloped portion 825 of the inclined surface may extend from first sloped portion 820 to outlet end 110. First sloped portion 820 may extend from inlet end 105 to second sloped portion 825 at a first angle of approximately 5° the first angle being measured between first sloped portion 820 and an axis A-A parallel to the ground. Second sloped portion 825 may extend from first sloped portion 820 to outlet end 110 at a second angle of approximately 0°, the second angle being measured between second sloped portion 825 and the axis A-A parallel to the ground. As depicted in FIG. 8, the first angle may be greater than the second angle. The difference between the first angle and the second angle may control the rate and amount of flow of wastewater across the inclined surface of flared end ramp 100.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A flared end ramp comprising:

an inlet end configured to connect to a pipe;

a plurality of protrusions on an upper side of the inlet end;

an outlet end, wherein the outlet end comprises a distal end of the flared end ramp;

an inclined surface extending between the inlet end and the outlet end of the flared end ramp, wherein the outlet end of the flared end ramp has a width that is larger than a width of the inlet end of the flared end ramp such that the inclined surface is angled laterally outward from the inlet end toward the outlet end;

a plurality of drainage ribs extending laterally on the inclined surface from the inlet end to the outlet end and extending vertically upward relative to the inclined surface;

a support foot extending laterally from the outlet end relative to a longitudinal axis extending between the inlet end and the outlet end, the support foot extending beyond the width of the outlet end; and an edge tab positioned on the support foot, the edge tab located outside of the width of the inlet end and extending vertically upward relative to the support foot.

2. The flared end ramp of claim 1, further comprising:

an inner tab positioned on the support foot of the outlet end, the inner tab extending vertically upward relative to the support foot.

3. The flared end ramp of claim 2, wherein:

at least a portion of the flared end ramp is configured to be placed inside a stormwater chamber such that the inner tab is positioned inside the stormwater chamber and the edge tab is positioned outside of the stormwater chamber.

4. The flared end ramp of claim 2, further comprising a second edge tab positioned on a second support foot and a second inner tab positioned on the second support foot, the second edge tab and the second inner tab extending vertically upward relative to the second support foot.

5. The flared end ramp of claim 1, further comprising a fastener configured to connect at least two of the plurality of protrusions directly to each other, thereby securing the flared end ramp to the pipe.

6. The flared end ramp of claim 5, wherein the fastener is a threaded rod or one or more zip ties.

7. The flared end ramp of claim 1, further comprising an indent on the inlet end configured to prevent the pipe from sliding towards the outlet end.

8. The flared end ramp of claim 7, wherein the indent is rounded with a curvature corresponding to a radius of the pipe and wherein the indent protrudes upward from the upper side of the inlet end to a distance that is level with an inside diameter of the pipe.

9. A flared end ramp comprising:

an inlet end configured to connect to a pipe;

an outlet end, wherein the outlet end comprises a distal end of the flared end ramp;

an inclined surface comprising a first sloped portion extending from the inlet end to a second sloped portion and the second sloped portion extending from the first sloped portion to the outlet end, wherein the outlet end of the flared end ramp has a width that is larger than a width of the inlet end of the flared end ramp such that the inclined surface is angled laterally outward from the inlet end toward the outlet end;

a plurality of drainage ribs extending laterally on the inclined surface from the inlet end to the outlet end and extending vertically upward relative to the inclined surface;

a support foot extending laterally from the outlet end relative to a longitudinal axis extending between the inlet end and the outlet end, the support foot extending beyond the width of the outlet end; and an edge tab positioned on the support foot, the edge tab located outside of the width of the inlet end and extending vertically upward relative to the support foot.

10. The flared end ramp of claim 9, wherein a first angle between an axis parallel to the ground and the first sloped portion is greater than a second angle between the second sloped portion and the axis parallel to the ground.

11. The flared end ramp of claim 10, wherein the first angle is approximately 5 degrees.

12. A flared end ramp, comprising:

an inlet end configured to connect to a pipe;

an outlet end, wherein the outlet end comprises a distal end of the flared end ramp;

an inclined surface extending from the inlet end to the outlet end, wherein the outlet end of the flared end ramp has a width that is larger than a width of the inlet end of the flared end ramp such that the inclined surface is angled laterally outward from the inlet end toward the outlet end;

a plurality of drainage ribs extending laterally on the inclined surface from the inlet end to the outlet end;

a support foot extending laterally from the outlet end relative to a longitudinal axis extending between the inlet end and the outlet end, the support foot extending beyond the width of the outlet end; and an edge tab positioned on the support foot, the edge tab located outside of the width of the inlet end and extending vertically upward relative to the support foot.

13. The flared end ramp of claim 12, wherein the plurality of drainage ribs comprise a length of 43 inches to 56 inches.

14. The flared end ramp of claim 12, wherein the plurality of drainage ribs comprise a length of 43 inches.

15. The flared end ramp of claim 12, wherein the plurality of drainage ribs extend completely from the inlet end to the outlet end.

16. The flared end ramp of claim 12, wherein the inclined surface comprises a first sloped portion extending from the inlet end to a second sloped portion and the second sloped portion extending from the first sloped portion to the outlet end.

17. The flared end ramp of claim 16, wherein a first angle between an axis parallel to the ground and the first sloped portion is greater than a second angle between the second sloped portion and the axis parallel to the ground.

18. The flared end ramp of claim 17, wherein the first angle is approximately 5 degrees.

* * * * *